United States Patent [19]

Bourbon

[11] 4,231,497

[45] Nov. 4, 1980

[54] POURING SPOUT WITH PIVOTED NONUSE POSITION

[76] Inventor: Jean Bourbon, B.P. 1, Saint-Lupicin, France, 39170

[21] Appl. No.: 6,205

[22] Filed: Jan. 24, 1979

[30] Foreign Application Priority Data

Jan. 25, 1978 [FR] France ..... 78 02963

[51] Int. Cl.[3] ..... B67D 5/06; B67C 9/00

[52] U.S. Cl. ..... 222/527; 222/567

[58] Field of Search ..... 222/567, 527, 566, 526, 222/529, 533, 534, 530, 570, 536; 193/2 A, 25 A

[56] References Cited

U.S. PATENT DOCUMENTS 1,553,134 4/1925 O'Reilly ..... 222/536

3,053,423 9/1962 Mortara ..... 222/567

*Primary Examiner*—Stanley H. Tollberg

*Attorney, Agent, or Firm*—Lewis H. Eslinger

[57] ABSTRACT

This invention relates to the transfer of liquid products, having special application to oil drums and including a pouring spout which is characterized by an attachment which is extended, on the opposite side to the inlet cross-section of an oblong opening, by a chute connected to the attachment by an articulation zone perpendicular to its longitudinal axis, the chute being provided with catch-type assembly members which cooperate with complimentary members carried by the attachment and which together ensure the maintenance and immobilization of the chute in a direction differing from that of the attachment.

7 Claims, 7 Drawing Figures

Fig-1
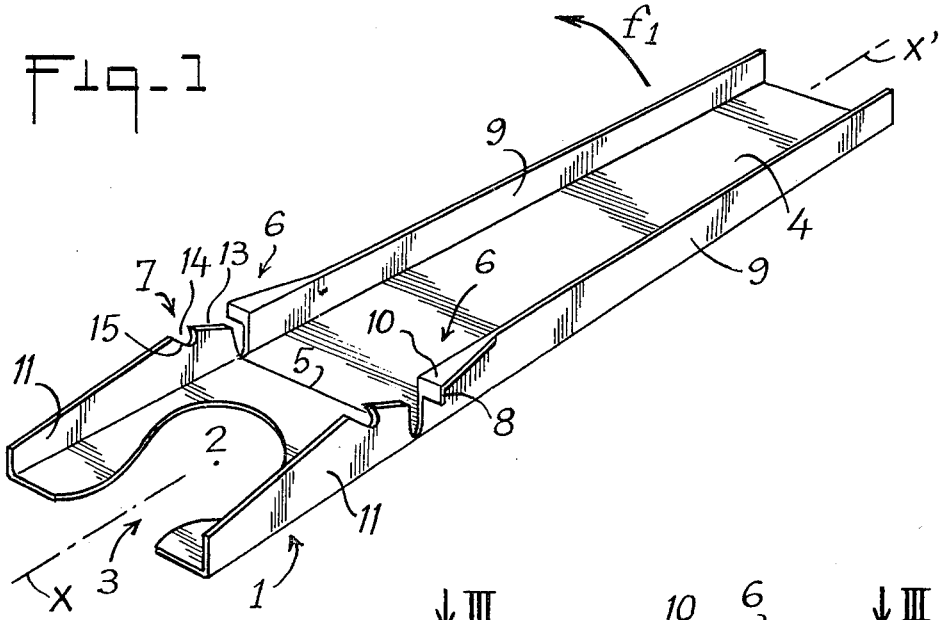
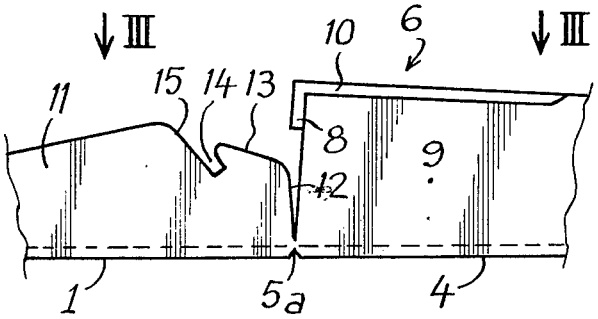
Fig-2
Fig-4
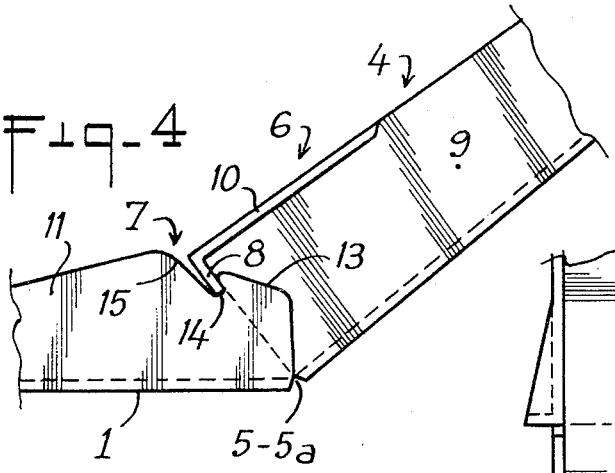
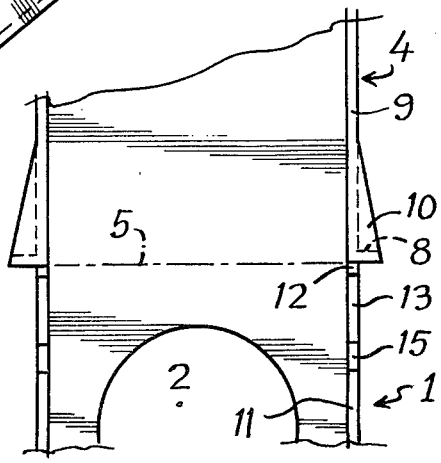
Fig-3

POURING SPOUT WITH PIVOTED NONUSE POSITION

BACKGROUND OF THE INVENTION

The present invention relates to pouring spouts for various containers and more specifically for containers of the drum type having a neck or the like which projects slightly from the surface carrying the same and generally retracted to a greater or lesser extent with respect to the edge of said surface or from the connection zone between the latter and the actual drum casing.

The above containers are known to be the cause of various difficulties during the transfer of their content. These difficulties are due to the fact that, at least at the start of transfer, the liquid product tends in the case of a limited inclination of the container to run along the neck and to follow the walls of the container, while in the case of a more pronounced inclination thereof it does not make it possible by increasing the flow to overcome the surface tension and obtain a jet which can be accurately directed. However, a pronounced inclination of such a drum at the start of transfer produces a jet which issues in an irregular manner and whose direction is difficult to control.

To obviate the above disadvantages it has been proposed to use conventional funnels, but the latter have not proved successful in view of the fact that in many cases they only constitute an intermediate member having in fact the same access difficulties as the receiving container, particularly when a difference in level exists between the latter container and the drum. It has also been proposed to add to such drums a pouring spout mounted on the neck and which can be oriented on the latter so as to facilitate transfer. Even if such spouts make it possible to reduce the above-mentioned disadvantages it should be noted that they do not give complete satisfaction because, in general, they do not permit an adequate spacing of the fine stream or jet of liquid with respect to the drum casing or in the case that they meet this requirement they represent a cumbersome accessory disadvantageous with respect to the storage and transportation of such a drum.

BRIEF SUMMARY OF THE INVENTION

The present invention aims at solving the above problem by supplying a pouring spout which can be easily adapted to the neck of a container on which it can be placed to occupy a position taking up little space outside the periods of use, as well as a pouring position which is particularly suitable for eliminating dangers of uncontrolled transfer and any running out of the jet of liquid product supplied.

The invention therefore relates to a pouring spout for various containers of the type having an attachment offering an oblong opening open from one of its edges so as to permit its fitting by sliding and its maintaining in place on the neck of a container, wherein said attachment is extended, on the opposite side to the inlet cross-section of the oblong opening, by a chute connected to the attachment by an articulation zone perpendicular to its longitudinal axis, said chute being provided with catch-type assembly members which co-operate with complimentary members carried by the attachment and which together ensure the maintenance and immobilization of the chute in a direction differing from that of the attachment.

BRIEF DESCRIPTION OF THE DRAWINGS

The invention will be described in greater detail hereinafter relative to non-limitative embodiments and with reference to the attached drawings, wherein show:

FIG. 1 a perspective view of the object of the invention.

FIG. 2 a partial side view showing on a larger scale a construction detail of the object of the invention.

FIG. 3 a partial plan view along the line III—III of FIG. 2.

FIG. 4 a part elevation analogous to FIG. 2, but showing another characteristic position of use of the object of the invention.

DETAILED DESCRIPTION OF THE PREFERRED EMBODIMENTS

Figure 5:
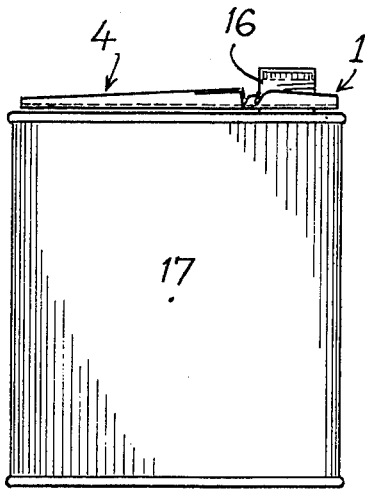
FIGS. 5 and 6 elevations illustrating an example of use of the object of the invention.

According to the invention the pouring spout illustrated in FIG. 1 comprises an attachment 1 having an oblong opening 2 which issues or opens onto one of the edges of attachment 1 by an inlet section 3, whose width is less than that of opening 2. Preferably opening 2 is in the form of a circular cutout, whose diameter is equal, except for the necessary tolerance, to the external diameter of the necks of the containers and drums such as drums containing for example a few liters which are frequently used in very varied applications or containing industrial products or where a subsequent transfer of the liquid is necessary.

The attachment 1 is extended at the opposite side to the edge corresponding to the inlet cross-section 3 by a chute 4 which is preferably, but not exclusively, realized so as to have a progressively decreasing cross-section from the connection with attachment 1. FIG. 1 shows that the connection between attachment 1 and chute 4 is provided by an articulation zone 5 which extends transversely to axis X—X′ passing through the longitudinal axis of chute 4, the axis of the attachment 1 and that of the inlet section 3. The articulation zone 5 can be realized in numerous different ways and in particular by providing a groove such as 5*a* (FIG. 2) in the material which forms attachment 1 and chute 4, which can advantageously be made from a moulded plastic material. The articulation zone 5 is in all cases provided in such a way that it permits the pivoting, articulation or displacement in the direction of arrow $f_1$ of chute 4 with respect to articulation 1 from a stable position in which said chute preferably extends in the same plane as attachment 1. Although this is not shown it is possible to give chute 4 a position differing from that of attachment 1 in the rest position.

Chute 4 has catch-type assembly members 6 which serve to co-operate, after pivoting in the direction of arrow $f_1$, with complimentary member 7 carried by attachment 1. In the embodiment shown in FIG. 1 the catch-type assembly members 6 are constituted, as can be gathered from FIGS. 2 and 3, by members 8 formed by two lateral flanges or wings 9 extending in the same direction the longitudinal edges of chute 4 to which they give an approximately U-shaped cross-section. In this embodiment members 8 are formed from the upper edges and the outer faces of flanges 9 and can be reinforced by right angled edges 10, connecting them to the upper edges of flanges 9. In all cases the members 8 are formed so as to face two flanges 11 on attachment 1 in an identical manner to chute 4. In the part facing flange 9 and member 8, from which flange 11 is separated by a slot 12, said flange 11 has a ramp 13 leading to an oblique rising direction of slot 12 up to the upper edge of flange 11 and leading to a notch 14, which is connected to said edge by a second ramp 15.

The pouring spout according to the invention, as described with respect to the embodiment of FIG. 1, has a first state in which the chute 4 extends, as stated hereinbefore, in the plane or extension of attachment 1. However, the pouring spout may have another stable state in which, as shown in FIG. 4, the chute occupies a stable position with respect to attachment 1 by being inclined relative to the latter. Thus, on considering attachment 1 in the immobile state the displacement of chute 4 in the direction of arrow $f_1$ has the effect of making members 8 slide on ramps 13 up to the time, whereby elastic reaction, they penetrate the notches 14. Such a co-operation is dependent on the relative displacement, either of flanges 9 in the direction of one another or the flanges 11 in opposite directions to one another, in such a way as to permit a relative overlapping and the passage of flanges 11 externally of flanges 9 so as to bring the notches 14 into a reception position for members 8. In this position the members 8 are sufficiently engaged in notches 14 to retain and immobilize the chute 4 in a position of inclination with respect to the plane of attachment 1.

Figure 6:
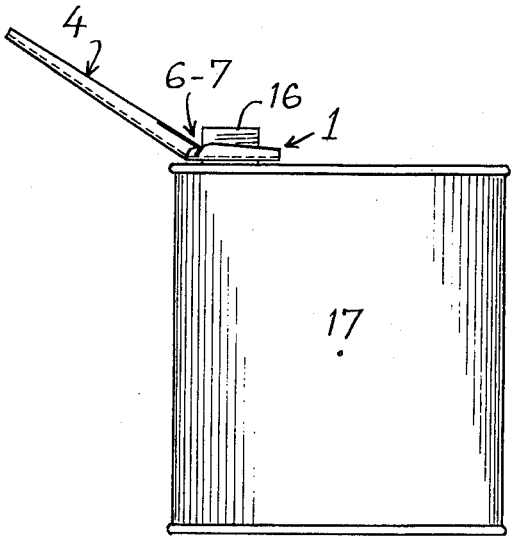

These two possibilities make it possible to envisage a prior fitting of the pouring spout on neck 16 of a container 17, as illustrated in FIG. 5, in the form of a drum having a content of a few liters and as is generally used for containing oil for industrial or domestic use. The pouring spout is fitted by sliding and introduction, perpendicular to the axis of neck 16 of attachment 1 via its inlet section 3 up to the time when opening 2 engages the neck 16 on which the attachment is maintained by elastic reaction, while at the same time authorising a relative angular orientation of the pouring spout making it possible to bring the chute 4 into the largest axis of drum 17 in order to integrate the pouring spout with the general overall dimensions of the container, without thus prejudicing the storage and transportation volume of the latter. During use it is merely necessary to angularly displace the pouring spout in such a way that the chute 4 is directed towards the nearest edge of the surface carrying the neck 16, in the circumstances subjecting the spout to a rotation of 180°. Chute 4 is thus located outside the casing of the drum or container 17 and can at this time be brought into the position of use, as illustrated in FIG. 6, by the co-operation of the assembly members 6 and the complimentary members 7, which ensure its maintenance in a plane differing from that of attachment 1 in order to facilitate the outflow of the product contained in drum 17 and which has to be transferred.

The object of the invention, as can be clearly gathered from the description and drawings, thus permits the total elimination of running out and the problems of transfer which occur with containers such as drums having a neck of limited height retracted with respect to the surface carrying the same and in particular during the initial transfer phase, i.e. when such drums are full. Thus, in its effective position of use, chute 4 makes it possible to move the jet of liquid away from the casing of the container or drum and offers a better possibility of initial inclination of a full drum, due to the fact that its inclination with respect to the attachment 1 brings the free end of the chute 4 into a plane higher than that of the surface carrying the neck 2 in the case of a drum position as illustrated in FIG. 6. It should be noted that the possibility of orienting the chute 4 on neck 16 via opening 2 makes it possible to retain the advantages, even when it is desired or considered preferable to effect a transfer by placing the drum 17 preferably flat on one of the sides of its casing when the latter is of the rectangular parallelpiped-type.

Figure 7:
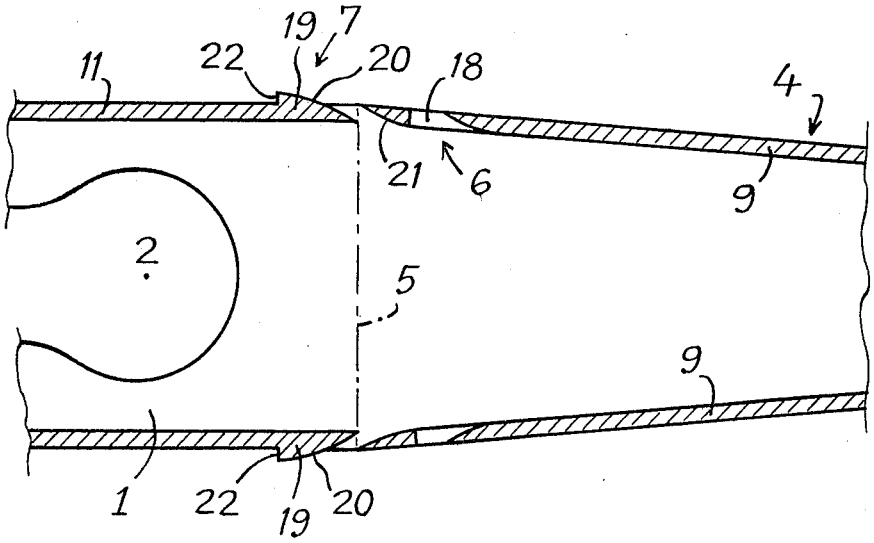
FIG. 7 a part section analogous to FIG. 3 and showing a constructional variant of the object of the invention.

FIG. 7 shows another embodiment according to which the catch-type assembly member 6 comprise slots or windows 18 made in the flanges 9 of chute 4. The complimentary members 7 are then constituted by teeth or projections 19 which preferably project from the outer surface of flanges 11 of attachment 1. The teeth or projections 19 have an asymmetrical profile offering a ramp 20 in the direction of a complimentary ramp 21 on the inner faces of flanges 9 of chute 4. The ramps 20 are connected by abrupt shoulders 22 to the outer surfaces of flanges 11.

The constitution of the assembly and complimentary members as shown in FIG. 7 makes it possible to facilitate the overlapping of the flanges during the pivoting or articulation of chute 4 in the direction of arrow $f_1$ in view of the fact that the co-operation of ramps 20 and 21 then assures the relative moving apart of flanges 9, as well as the relative moving together of flanges 11 in order to permit the relative pivoting about the articulation zone 5, together with the passage of the teeth or projections 19 up to the time where the latter engage in the slots or windows 18 in which they are maintained via abrupt shoulders or faces 22.

The return of chute 4 to its initial position is initially obtained by acting in such a way as to bring about a relative spacing apart of flanges 9 so as to disengage the projections 19.

Although this is not shown it is obivous that the slots or windows 18, as well as the teeth or projections 19 can be shaped differently and that in particular the teeth or projections 19 may be constituted by protuberances, for example, in the form of semi-circular buttons or bosses which penetrate complimentary openings in flanges 9. In the same way the position of the members as described in FIG. 7 can be reversed and then flanges 9 have teeth or projections and flanges 11 the corresponding openings.

The invention is not limited to the embodiments described and represented hereinbefore and various modifications can be made thereto without passing beyond the scope of the invention.

What is claimed is:

1. A pouring spout for various containers of the type having an attachment offering an oblong opening open from one of its edges so as to permit its fitting by sliding and its maintaining in place on the neck of a container, wherein said attachment is extended, on the opposite side to the inlet cross-section of the oblong opening, by a chute connected to the attachment by an articulation zone perpendicular to its longitudinal axis, said chute being provided with catch-type assembly members which co-operate with complimentary members carried by the attachment and which together ensure the maintenance and immobilization of the chute in a direction differing from that of the attachment.

2. A pouring spout according to claim 1, wherein the catch-type assembly members and the complimentary members are provided on raised lateral flanges extending the edges of the attachment and of the chute perpendicular to the articulation zone.

3. A pouring spout according to claim 1, wherein the catch-type assembly members co-operate with complimentary members by elastic deformation.

4. A pouring spout according to claim 1, wherein the catch-type assembly members and the complimentary members are constituted by openings and protuberances respectively.

5. A pouring spout according to claim 1, wherein the catch-type assembly members and the complimentary members are constituted by protuberances and openings respectively.

6. A pouring spout according to claim 4, wherein the protuberances are constituted by members and the openings by notches.

7. A pouring spout according to claim 4, wherein the protuberances are teeth or projections with an asymmetrical profile and the openings are slots or windows.

* * * * *